United States Patent [19]

Nelson

[11] Patent Number: 4,893,591

[45] Date of Patent: Jan. 16, 1990

[54] MANIFOLD FLAME ARRESTOR

[75] Inventor: Kevin G. Nelson, Tulsa, Okla.

[73] Assignee: Facet Enterprises, Inc., Tulsa, Okla.

[21] Appl. No.: 247,739

[22] Filed: Sep. 22, 1988

[51] Int. Cl.[4] ..... F02B 75/18

[52] U.S. Cl. ..... 123/52 MF; 123/198 D

[58] Field of Search ..... 123/52 M, 52 MF, 198 D; 261/DIG. 6; 60/39.11; 55/DIG. 28; 431/346

[56] References Cited

U.S. PATENT DOCUMENTS 4,509,466 4/1985 Bernardoni et al. ..... 123/52 MF

*Primary Examiner*—Noah P. Kamen

*Attorney, Agent, or Firm*—Head & Johnson

[57] ABSTRACT

A manifold flame arrestor system for use with an internal combustion engine having a plurality of cylinders, each cylinder having an intake port and means of ignition of combustible mixtures drawn into the cylinder through the intake port, and an intake manifold connecting the intake ports of a plurality of cylinders, the system serving to reduce the possibility of transmission of combustion producing flame from a cylinder into the intake manifold comprising a flame arrestor positioned between the intake manifold and each cylinder intake port, each flame arrestor permitting passage of combustible mixtures therethrough but prohibiting the passage of flame therethrough.

2 Claims, 2 Drawing Sheets

MANIFOLD FLAME ARRESTOR

SUMMARY OF THE INVENTION

An internal combustion engine typically includes a plurality of cylinders each having at least one intake and one exhaust port. The intake and exhaust ports are sequentially opened and closed by valves, the valve for each intake port being termed an "intake valve" and the valve of the exhaust port being termed an "exhaust valve". The internal combustion engine functions in response to combustible fuel mixtures draw into the cylinders through the intake ports when the intake valve is opened. The combustible mixture is typically in the form of air and vaporized fuel, commonly referred to as a fuel/air mixture. An intake manifold connects a source of fuel/air mixture, such as a carburetor, to a plurality of intake ports. After the fuel/air mixture is drawn into a cylinder, both the intake and exhaust valves close, the mixture is compressed and after being compressed is ignited, causing combustion of the mixture. The heat of combustion causes the mixture to expand, thus urging the piston in the direction away from the piston head, producing energy. On the next cycle, the exhaust valve opens and the products of combustion are discharged through the exhaust valve into an exhaust manifold and ultimately into the atmosphere.

As long as the intake valve functions perfectly and as long as combustion occurs only when the intake valve is fully closed, flame does not pass from the cylinder into the intake manifold. On the other hand, if for any reason, combustion takes place prematurely in the cylinder without the intake valve being fully closed, or if combustion continues after the intake valve opens, or if the intake valve is defective and does not fully close, flame resulting from combustion in the cylinder can pass rearwardly through the intake valve, into the intake manifold and to combustible mixtures within the intake manifold. When this happens, damage to parts of the engine can occur. This premature combustion or "backfire" as it is frequently called, can spread throughout the intake manifold and into the carburetion system and can thereby cause significant engine damage.

A known expedient for preventing passages of flame externally of an engine is called a "flame arrestor". A flame arrestor is frequently used with an engine which is confined to a closed or poorly ventilated environment, such as the hold of a boat or ship. Such flame arrestors are typically positioned at the carburetor intake so that flame can not pass externally of the engine. Positioning a flame arrestor at the carburetor intake or, even if positioned between the carburetor and the intake manifold, however, does not prevent the possibility of engine damage when flame passes from a cylinder into the intake manifold.

The present invention reduces the possibility of engine damage by preventing the consequences of flame passing from a cylinder into the intake manifold. This is accomplished by positioning a flame arrestor between the intake manifold and each cylinder intake port. Each flame arrestor is of a type which permits the passage of combustible mixtures therethrough from the intake manifold into the intake port and, thus, into the cylinder when the intake valve is opened; but which prohibits the passage of flame in the reverse direction; that is, that which prohibits the passage of flame or ignition producing sparks, or the like, from a cylinder through its intake port and into the intake manifold.

A better understanding of the invention will be had by reference to the following description and claims taken in conjunction with the attached drawings.

DESCRIPTION OF THE PREFERED EMBODIMENTS

Figure 2:
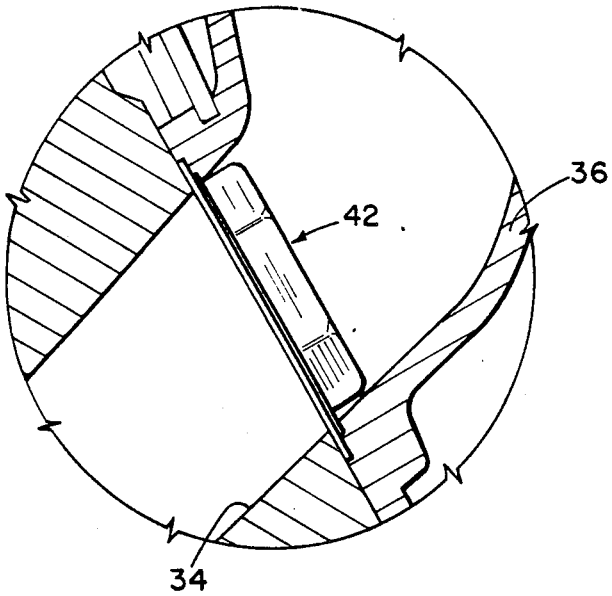
FIG. 2 is an enlarged fragmentary view taken at segment 2 of FIG. 1 showing the flame arrestor between the intake port and the intake manifold.
Figure 1:
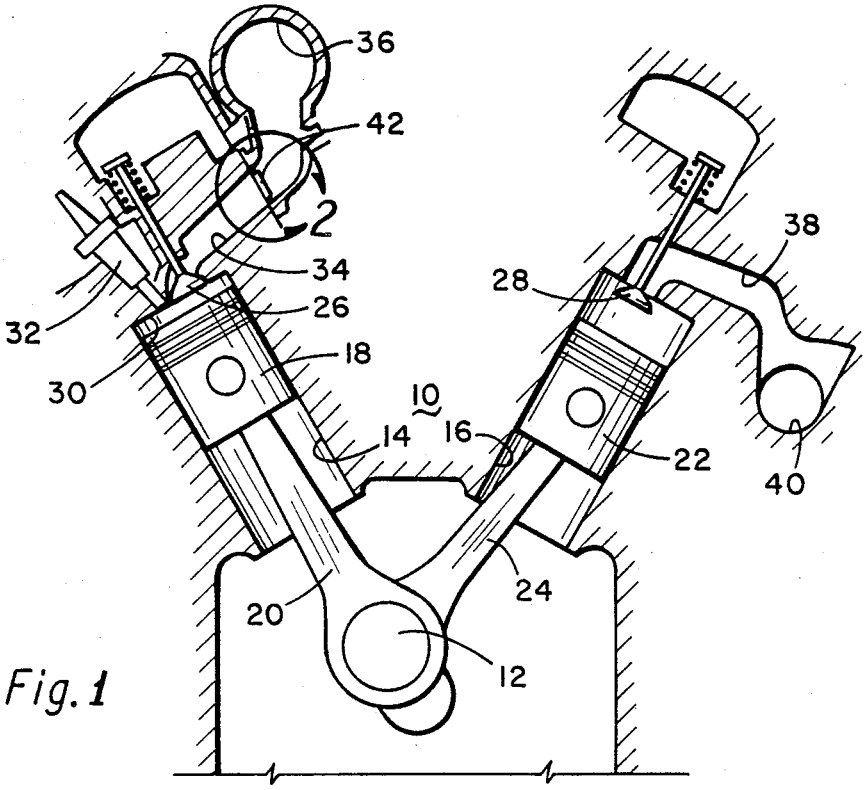
FIG. 1 is an exemplified cross-sectional view of a typical internal combustion engine showing two cylinders. The cylinder on the left is shown with an intake valve, an intake port, an intake manifold and a spark plug. The cylinder on the right is shown in a different cross-section, which show an exhaust valve, an exhaust port, and an exhaust manifold. The cylinder on the left shows the inclusion of a flame arrestor between the intake port and the intake manifold.

Referring to the drawings and first to FIG. 1, the rudimentary portions of an internal combustion engine are illustrated. The engine includes a block 10 which supports a rotatable crank shaft 12. The block 10 includes a plurality of cylinders and the usual engine typically has two to eight or more cylinders. The type of engine illustrated for purposes of exemplifing the invention is what is termed a "V" engine and usually such engines will be V6, V8, V12 etc., meaning 3, 4, 6, etc. cylinders in each of two banks. Another common engine configuration is termed "in-line", meaning that all the cylinders are in a common plane. Whether the engine is an inline, a "V" configuration or otherwise is not relevant to this invention, but a "V" engine is illustrated since it is one which is commonly employed for mobile equipment including cars, trucks, tractors and so forth.

The block 10 is shown in a cross-section exposing two cylinders 14 and 16. Such cylinders would not commonly be in the same plane drawn perpendicular to the engine longitudinal axis, but the cylinders are shown as if in the same plane for purposes of illustration. Cylinder 14 has a piston 18 therein with a crank arm 20 connecting to the crank shaft 12. In like manner cylinder 16 has a piston 22 and crank arm 24. The usual internal combustion engine has at least one intake valve 26 which is shown with respect to cylinder 14, and at least one exhaust valve 28 which is shown with respect to cylinder 16. By cam shaft mechanisms (not shown), intake valve 26 and exhaust valve 28 are opened and closed in synchronization with the rotation of crank shaft 12. In the usual four cycle engine, on one cycle the intake valve 26 is opened as the piston 18 moves away from cylinder head 30 to draw a combustible mixture into the interior of the cylinder. On the next cycle the piston 18 moves towards the cylinder head 30. With both the exhaust and intake valves closed, the combustible mixture is comprssed. After the combustible mixture is compressed, it is ignited such as by a spark plug 32 (or by glow plug or other means if the engine works on a diesel cycle). Both the intake and the exhaust valve remain closed as the ignited combustible mixture expands and applies force against piston 18 to drive it away from cylinder head 30, which force is that which enables an internal combustion engine to extract energy from liquid fuel. On the next cycle, as the piston 18 moves towards piston head 30, the exhaust valve, such as exhaust valve 28 in cylinder 16, opens to permit the products of combustion to be expelled out of the cylinder.

Thus, while in the illustrated exemplified view of FIG. 1, cylinder 14 is shown only with an intake valve 26, and cylinder 16 is shown only with an exhaust valve 28. In order to function, each of the cylinders must have both intake and exhaust valves.

A fuel/air mixture is drawn into cylinder 14 when the intake valve 26 is opened and as the piston 18 moves away from piston head 30, through an intake port 34. This fuel/air mixture is supplied to the intake port 34 by means of an intake manifold 36 connecting the intake port 34 to, as previously indicated, a carburetion system. In some instances, a single carburetion system can supply combustible fuel mixtures to more than one cylinder so that the intake manifold 36 may communicate a plurality of intake ports with each other and in turn with a carburetion system.

If the internal combustion engine of FIG. 1 operates perfectly, combustion of the fuel mixture within the cylinder 14 above piston 18 occurs only when the intake valve 26 is fully closed so no portion of the flame of combustion passes rearwardly into the intake port 34 and, thus, into the intake manifold 36. However, in actual operation and particularly because of the increased criticality of timing to achieve more complete combustion so as to reduce pollution levels, in some instances combustion can occur in cylinder 14 when the intake valve 26 is not fully closed. This can occur due to preliminary ignition caused by a variety of factors including glowing carbon deposits remaining with the cylinder. In any event, if combustion occurs while the intake valve 26 is not fully closed, the flame of combustion can pass into the intake port 34 and from thence into the intake manifold 36. When the flame of combustion enters the intake manifold 36, serious consequences can occur. A flame within the intake manifold can cause fuel mixtures in the manifold to ignite. The resulting explosion can migrate to the intake port of other cylinders and into the carburetion system. Not only does the passage of flame from the cylinder 14 into intake port 34 cause the possibility of damage to engine components, but it also can result in a fire. In any event, it is highly desirable that provisions be made to prevent the inadvertent passage of the flame of combustion from a cylinder of an internal combustion engine back into an intake manifold or, back into any engine component connected to the intake port 34.

For this reason, according to the principles of this invention, a flame arrestor 42 is positioned in the intake port 34. More specifically, a flame arrestor 42 is placed in the passageway communicating the intake port 34 and the intake manifold 36. In the typical internal combustion engine placement this is best accomplished at the point wherein the intake manifold 36 connects to the engine block 10, or to the engine head, which in effect is a removeable portion of the engine block 10, the head not being separately shown in FIG. 1. The intake manifold is typically (although not shown in the drawing) bolted to the engine block 10. By unbolting the manifold, a flame arrestor 42 can be positioned between the manifold and each intake port 34 of the engine to which it connects.

Referring to FIG. 1, cylinder 16 will, in the practice of the invention, have a flame arrestor in its intake port the same as cylinder 14 however the drawing shows only the exhaust port 38 and a flame arrestor is not required nor is one desirable in the exhaust port 38. Therefore, FIG. 1 illustrates that the flame arrestor 42 is positioned in the intake port of each cylinder, but not in the exhaust port.

Figure 4:
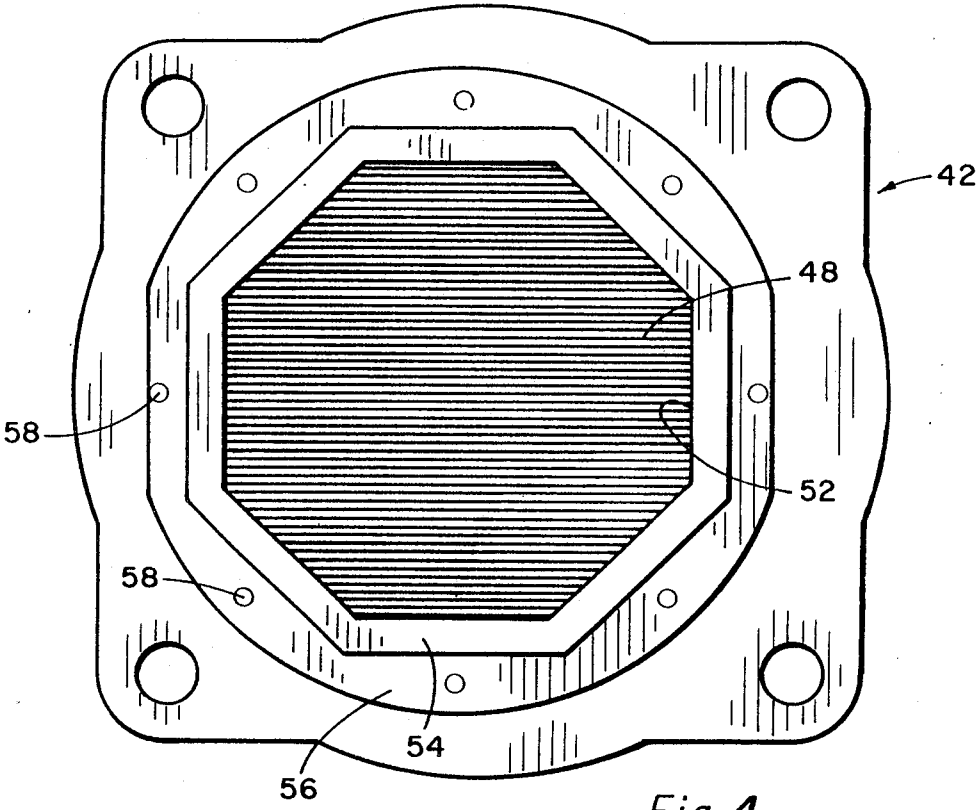
FIG. 4 is an elevational front view, shown partially cut away, of a flame arrestor as employed in practicing the invention.
Figure 3:
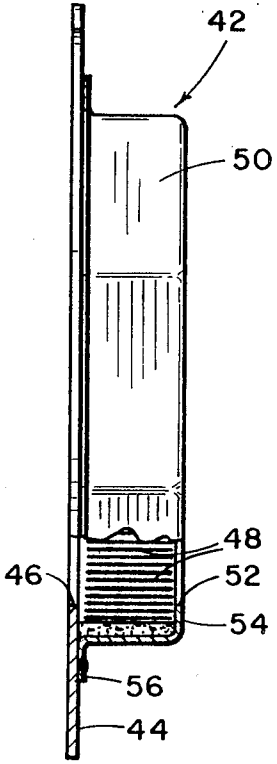
FIG. 3 is an elevational side view, shown partially cut away, of a flame arrestor as employed in FIGS. 1 and 2.

FIGS. 3 and 4 show exemplary configurations of a flame arrestor which can be employed in practicing the invention. The flame arrestor 42 including a flat metallic base member 44 having an opening 46 therein are substantially corresponding in cross-sectional area to the area of the intake port 34.

Positioned on the base member 44 are a plurality of thin leaves 48 of metallic material which are spaced apart from each other. These metallic leaves 48 are spaced sufficiently far apart so as to permit the free passage of combustible mixtures from the intake manifold 36 into the engine intake port 34, and correspondingly, free passage of mixtures in the opposite direction, but serve to cool and quench a flame which would attempt to pass rearwardly through the flame arrestor 42, that is, the flame arrestor will intercept any flame which would attempt to pass from the intake port 34 into the intake manifold 36. This flame arrest effect is achieved because of cooling provided by the metallic leaves 48. Even though combustible mixture may pass rearwardly through the flame arrestor, any flame accompanying such mixture will be snuffed out so as to prevent the passage of ignition from intake port 34 into the interior of intake manifold 36.

As shown in FIGS. 3 and 4, to retain the metallic leaves 48 in position on the base plate or flange 44, a cover cap or retainer tray 50 is employed. The cover cap 50 has an opening 52, formed by an integral circumferential lip 54 through which combustible mixtures pass from the intake manifold into the intake port of each cylinder. An integral flange portion 56 is contiguous and parallel to the base portion 44. The flange portion 56 of the cover cap 50 is spot welded at 58 to the base portion 44.

The specific configuration of the flame arrestor as shown in FIGS. 3 and 4 is exemplary, as the arrestor can take different shapes. The requirement is that it be positionable between the intake valve 26 and the intake manifold 36 of each cylinder of the engine and be constructed so that it will not unduly restrict the flow of combustible mixtures into the cylinders, but will prevent the passages of flame rearwardly therethrough.

The invention has been applied to a Caterpillar Tractor Company 3516 series engine which has 16 cylinders. Consequently, 16 flame arrestors—one for each cylinder are employed. These particular flame arrestors are Woods Energy Products, Inc. part number 0920100. Each flame arrestor consists of a flame arrestor core composed of approximately 104 stainless steel leaves which are 0.008 inches thick, 0.625 inches wide, and have a 15° angle of inclination with respect to the axis of openings 46 and 52. This core assembly is contained in a stainless steel retainer tray 50 which is then spot-welded to a stainless steel base plate 44. The leaves are spaced about 0.025" apart. Caterpillar bolts each flame arrestor to the cylinder head inside the inlet elbow of the intake manifold.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. With an internal combustion engine having a plurality of cylinders, each cylinder having an intake valve and a means of ignition of combustible mixtures drawn into the cylinder through the intake valve, and an intake manifold communicating with the intake valves of the plurality of cylinders, a system of reducing the possibility of the transmission of combustion producing flame from within a cylinder into the intake manifold, comprising:

a flame arrestor member sealably positioned in the path between the intake manifold and each intake valve, each flame arrestor member permitting bidirectional passage of combustible mixtures but prohibiting the passage of flame therethrough.

2. With an internal combustion engine having a plurality of cylinders, each cylinder having an intake port and a means of ignition of combustible mixtures drawn into the cylinder through the intake port, and an intake manifold connected to the intake port of each of the plurality of cylinders, a method of reducing the possibility of the transmission of flame from a cylinder into the intake manifold comprising the step of inserting a flame arrestor member sealably between the intake manifold and each cylinder intake port, each flame arrestor member being of the type permitting bidirectional passage of combustible mixtures but prohibiting the passage of flame therethrough.

* * * * *

Disclaimer and Dedication 4,893,591.—*Kevin G. Nelson,* Tulsa, Okla. MANIFOLD FLAME ARRESTOR. Patent dated Jan. 16, 1990. Disclaimer and Dedication filed Jun. 11, 1990, by the assignee, Facet Enterprises, Inc.

Hereby disclaims and dedicates to the Public the remaining term of said patent.

[ *Officiasl Gazette August 7, 1990* ]